US006367911B1

(12) United States Patent
Windel et al.

(10) Patent No.: US 6,367,911 B1
(45) Date of Patent: Apr. 9, 2002

(54) INK PRINTER HEAD COMPOSED OF INDIVIDUAL INK PRINTER MODULES, WITH AN ADAPTER PLATE FOR ACHIEVING HIGH PRINTING DENSITY

(75) Inventors: Harald Windel; Junming Zhang, both of Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 969 days.

(21) Appl. No.: 08/494,227

(22) Filed: Jun. 23, 1995

(30) Foreign Application Priority Data

Jul. 5, 1994 (DE) ..... 44 24 771

(51) Int. Cl.[7] ..... B41J 2/15; B41J 2/145
(52) U.S. Cl. ..... 347/40
(58) Field of Search ..... 347/40, 41, 71, 347/68, 44, 65, 43, 70

(56) References Cited

U.S. PATENT DOCUMENTS

| | | | | |
|---|---|---|---|---|
| 4,015,271 A | | 3/1977 | Sultan | 347/44 |
| 4,605,939 A | | 8/1986 | Hubbard et al. | 347/71 |
| 4,665,409 A | | 5/1987 | Behrens et al. | 347/47 |
| 4,752,789 A | | 6/1988 | Maltsev | 347/71 |
| 4,829,324 A | * | 5/1989 | Drake et al. | 347/63 |
| 5,057,854 A | * | 10/1991 | Pond et al. | 347/42 |
| 5,608,433 A | * | 3/1997 | Quate | 347/37 |

FOREIGN PATENT DOCUMENTS

| | | | | |
|---|---|---|---|---|
| DE | OS 31 17028 | | 11/1982 | |
| DE | OS 32 08 104 | | 9/1983 | |
| DE | GA435035 | | 6/1986 | |
| DE | OS 42 25 799 | | 2/1994 | |
| EP | 0 067 889 | | 12/1981 | |
| EP | 0 431 692 A1 | | 12/1990 | |
| EP | 0 486 256 | | 5/1992 | |
| JP | 6-40028 | * | 2/1994 | 347/40 |

* cited by examiner

*Primary Examiner*—Benjamin R. Fuller
*Assistant Examiner*—C. Dickens
(74) *Attorney, Agent, or Firm*—Schiff Hardin & Waite

(57) ABSTRACT

An ink printer head of individual ink printer modules operating according to the edge-shooter principle equipped with piezoelectric actuators is provided for use in printers for postage meter machines and correspondingly has a large number of nozzles arranged in columns. An assembly has n ink printer modules arranged in registry side-by-side with ink chambers open toward a front side of the assembly with an adapter plate matched to the front face and having openings in registry with ink chambers is disposed adjacent the front face. A nozzle plate adapted to the adapter plate is disposed in front of the adapter plate. The nozzle plate is supported by the adapter plate and a spatial matching between the larger ink chambers and the smaller nozzles is achieved. Moreover, the two ink chamber columns of a module are united to form one nozzle column. A reduction in the manufacturing outlay while preserving the requiring printing precision is achieved. A high degree of repetition is achieved by employing identical ink printer modules and ink paths of approximately identical length is also achieved. The nozzle apertures can be given a circular cross-section without difficulty.

14 Claims, 2 Drawing Sheets

INK PRINTER HEAD COMPOSED OF INDIVIDUAL INK PRINTER MODULES, WITH AN ADAPTER PLATE FOR ACHIEVING HIGH PRINTING DENSITY

BACKGROUND OF THE INVENTION

1. Field of the Invention

The present invention is directed to an ink printer head of the type composed of a stacked ink printer modules operating according to the edge-shooter principle and that are equipped with ink ejecting piezoelectric actuators.

2. Description of the Prior Art

Ink printer head of the above-described type are used in small, fast printers that are in turn a component of modern machines for franking postal matter or for printing addresses.

Differing from a standard office printer with line-by-line imprinting, the printing ensues in such smaller machines as a one-time franking imprint in one pass of the postal matter. The printing width determines the number of nozzles to be arranged in one column of the nozzle matrix, and thus also determines one dimension of the ink printer head. The capability of printing blocks having word and image characters is a feature available using such postage meter machines. Printer resolutions of approximately 200 dpi are required for assuring a good printing quality. This requires nozzle apertures having a width of 40 through 50 $\mu$m. High demands are thus made on the precision of the nozzle division and the drive thereof. Given a standard block width of one inch, the adjustment error must be kept below 10 $\mu$m.

German OS 42 25 799 discloses an ink printer head of the type initially described that is composed of a number of different modules, only one module thereof carrying the shared nozzle row at its end face. All modules have pressure chambers driveable by piezoactuators for ink ejection that are connected to the allocated nozzles via appropriately conducted channels. The connecting channels from module to module necessarily proceed orthogonally relative to the pressure chambers.

Although the advantage of only a single nozzle row is significant, the technological outlay for manufacturing the modules that differ from one another is still substantial.

Higher precision than that needed to produce the pressure chambers and a higher adjustment outlay are required for the connecting channels that proceed through a number of modules. The fact that the connecting channels have different lengths causes additional control problems. When the nozzles are manufactured of UV-sensitive glass in common with the ink channels using an etching technique, they consequently have a hydrodynamically disadvantageous, rectangular cross section that can only be manufactured in practice with a precision of $\geqq 5$ $\mu$m.

German OS 31 17 028 discloses a print element for ink printer devices having cylindrical ink channels that proceed in the print element and are at least partially encompassed by piezotransducers. This print element is composed of a head part, a channel plate adjacent thereto and a nozzle plate. The ink channels proceed parallel to one another in the head part. The channel plate has ink delivery channels into which the ink channels discharge at the one side and that form discharge apertures at the other side, which are connected to allocated nozzle apertures of the nozzle plate. Although approximately identical ink path lengths and round nozzle apertures are achieved with this ink printer head, a head volume too large for the initially described utilization in a postal franking machine would be required in order to achieve an imprint of 192 dpi, because of the 192 tubular piezotransducers. It is also difficult to contact the piezotransducers and to achieve acoustic decoupling between neighboring pressure chambers.

SUMMARY OF THE INVENTION

An object of the present invention is to achieve a print head suitable for use in a small postal franking machine having manufacturing outlay in comparison to known print heads used for that purpose while preserving the required printing precision.

The invention is to provide an ink printer head of the type initially described that is composed of identical ink printer modules having plate-shaped piezoelectric actuators and wherein the channels from the pressure chambers to the nozzles are of approximately equal length and neighboring pressure chambers are suitably acoustically decoupled.

It is a further object of the invention to provide such a print head having nozzles with a circular cross section produced more precisely then previously.

The above object is achieved in accordance with the principles of the present invention in an ink printer head formed by a number of side-by-side edge shooter ink printer modules forming a module assembly with a front side, each ink printer module having ink chambers therein open toward the front side of the assembly and being arranged in two columns with a slight spacing between the columns, an adapter plate covering the front side of said assembly and having openings therein in registry with the openings of the ink chambers in the respective ink printer modules, and a nozzle plate having nozzle apertures therein disposed over the adapter plate, the nozzle apertures being arranged in columns in the nozzle plate with the individual nozzle apertures disposed equidistantly from each other in each column and being offset from column-to-column so that no nozzle aperture is aligned with another nozzle aperture in a direction orthogonal to the column direction. The openings of the ink chambers in the front side of the assembly have a first dimension and the nozzle apertures have a second dimension which is smaller than the first dimension. The openings in the adapter plate have a first region having the first dimension and a second region having the second dimension. The openings in the adapter plate are disposed so that the respective first regions of the openings are in registry with the openings of the ink chambers and the respective second regions are in registry with the nozzle apertures.

In a preferred embodiment, each ink printer module has a pair of columns of openings in the adapter plate associated therewith. Since the nozzle openings in each ink printer module are arranged in two columns with a slight spacing between the columns, the pair of columns of openings associated with that ink printer module in the adapter plate is formed by one column of openings each having their first region in registry with one column of ink chamber openings, and the other column of openings in the pair each has its first region aligned with the respective ink chamber openings in the other column of the ink printer module. The respective smaller regions of the adapter plate openings in each column pair are meshed, so that those smaller regions, in turn, form a column. The column of smaller regions in each pair of adapter plate opening columns are in registry with the column of nozzle apertures in the nozzle plate allocated to that ink printer module.

Preferably ink is caused to be ejected from the ink chambers in an ink printer module by piezoelectric actuator, preferably a plate-shaped piezoelectric actuator. A number of advantages derive on the basis of the proposed arrangement.

Only one module type need be manufactured, preferably in a batch process. The number of ink printer modules in an ink printer head is based on the desired number of nozzles. A compact printer head structure with high packing density is achieved.

The adapter plate as well as the nozzle plate can be manufactured with high precision using a lithography technique. The openings in the adapter plate and the nozzle apertures in the nozzle plate can be manufactured in the same way with etching, laser drilling, sand blasting or LIGA technique. Punching would also be possible when the plates are steel. Only the thickness of the nozzle plate is critical for the nozzle length; all nozzles are thus of the same length.

The adapter plate fulfills a number of functions:

mechanical carrier of the thin nozzle plate mechanical and fluid connection between ink printer module and nozzles spatial matching between larger ink chambers and smaller nozzle apertures as well setting their spatial offset relative to one another reduction of 2n columns of ink chambers to n columns of nozzles.

The dimensions of the openings in the adapter plate can be dimensioned such that ink paths of approximately equal length are present.

The problem areas of printer resolution and the precision of the nozzle division (equidistance) and nozzle shape has been displaced away from the modules themselves to the combination composed of the adapter plate and the nozzle plate and can be governed at those components without difficulty on the basis of lithography techniques.

The disclosed structure of the ink printer modules of a first cover plate, an intermediate plate, a second cover plate and a spacer plate makes it possible to place the ink chambers either in the cover plate or in the intermediate plate. The offset of the ink chambers at both sides of the intermediate plate with mismatch and the presence of the spacer plate effect a good acoustic decoupling within a module as well as among the modules. The spacer plate is expediently provided with recesses for the piezoactuators and their leads.

The connection between the nozzle and adapter plates as well as between the latter and the front surface of the module can ensue with UV-activatable adhesive that is previously applied in the lithography technique steps.

It is also possible to use thermal actuators within the ink chambers instead of the piezoactuators.

DESCRIPTION OF THE PREFERRED EMBODIMENTS

Figure 1:
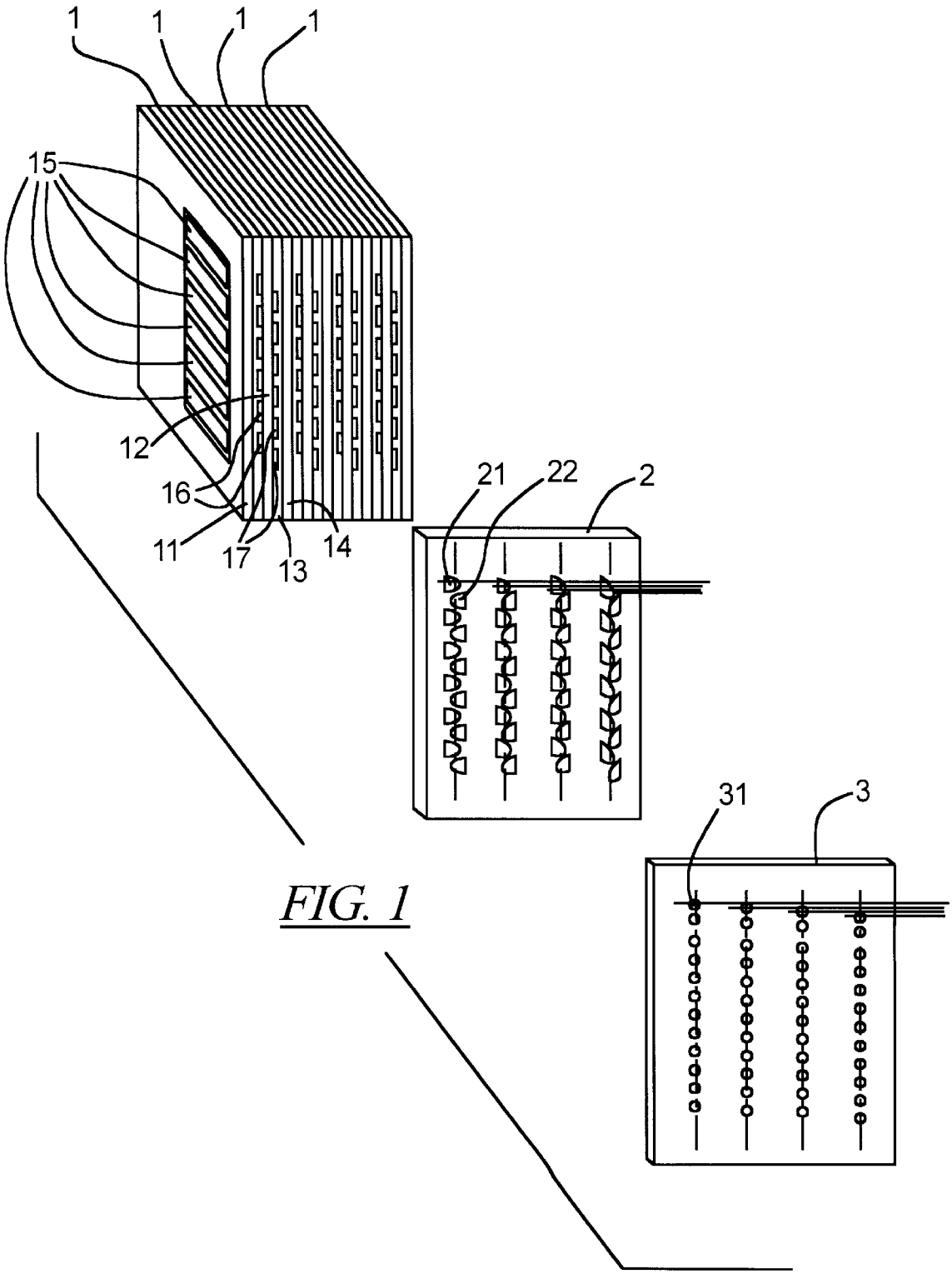
FIG. 1 shows an ink printer head constructed in accordance with the principles of the present invention in a schematic, exploded view.

As shown in FIG. 1, an ink printer head is composed of n(n=4) identical ink printer modules 1. The ink printer modules 1 are arranged in registry next to one another and their ink chambers 16 and 17 are open each with a substantially rectangular opening toward the common front side.

Adapted to the front surface formed in this way by the ink printer modules 1 is an adapter plate 2 which lies adjacent thereto. The adapter plate 2 is provided with openings 21 and 22 in registry with each of the ink chambers 16 and 17. A nozzle plate 3 having nozzle apertures 31 is arranged in front of the adapter plate 2 and is matched thereto. The openings 21 and 22 in the adapter plate 2 are matched to the width D shown in FIG. 2; of the ink chambers 16 and 17 in a first region and are aligned therewith. In a second region, the openings 21 and 22 are matched to the diameter d shown in FIG. 2; of the nozzle apertures 31 and are also align with them. The modules 1, the adapter plate 2 and the nozzle plate 3 are integrally bonded.

An ink printer module 1 (also see FIG. 2) is composed of a first cover plate 11, an intermediate plate 12 and a second cover plate 13 as well as a spacer plate 14. Ink chambers 16 are arranged under one another between the first cover plate 11 and the intermediate plate 12. Ink chambers 17 are arranged under one another between the second cover plate 13 and the intermediate plate 12. The ink chambers 17, however, are arranged offset by approximately one ink chamber width relative to the ink chambers 16, so that they are mismatched relative to one another. The cover plates 11 and 13 carry piezoactuators 15 in the regions neighboring the ink chambers 16 and 17 at their side facing away from the intermediate plate 12. The piezoactuators 15 are driven via electrical lines that are not shown. The ink chambers can be optionally formed either in the cover plates 11 and 13, as shown, or in the intermediate plate 12.

Corresponding to the number n (in this case, n=4) of the ink printer module 1, the nozzle plate 3 has n=4 columns with nozzle apertures 31. The nozzle apertures 31 are arranged equidistantly from one another in each column. From column to column, the nozzles are offset such that no nozzle aperture 31 aligns with another nozzle aperture 31 in a direction orthogonal to the column direction, but all nozzle apertures 31 are equidistantly arranged in the column direction of the ink printer head.

Corresponding to the number 2n (in this case, 2n=8) columns of ink chambers 16 and 17, the adapter plate 2 likewise has 2n=8 columns with openings 21 and 22. The columns of openings 21 and 22 allocated to an ink printer module 1 are arranged in pairs disposed relative to one another so that the openings 21 and 22 are arranged equidistantly from one another with their respective smaller regions matched to the nozzle apertures 31 aligned so as to be meshed with one another. The meshed, smaller regions of each pair of openings 21 and 22 allocated to an ink printer module 1 are thus aligned in a column in registry with the column of nozzle apertures 31 also allocated to that ink printer module 1.

The openings 21 and 22 are fashioned as semi-elliptical openings which are roughly kidney-shaped, whereas the nozzle apertures 31 are circular.

Figure 2:
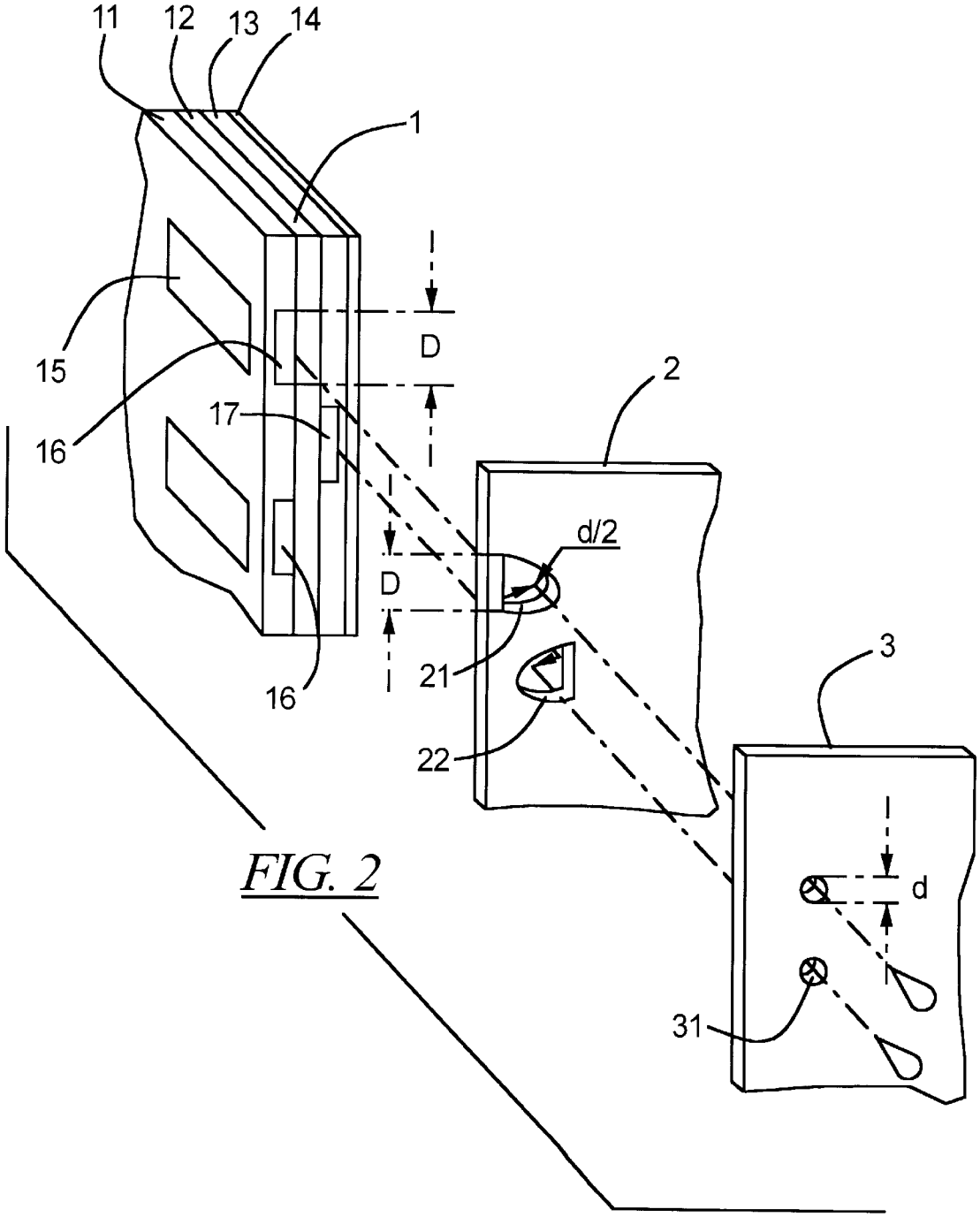
FIG. 2 shows an enlarged portion of an ink printer module in the printer head of FIG. 1 together with the surrounding area of the adapter and nozzle plate in a schematic, exploded view.

As may also be seen from FIG. 2, a pressure pulse emitted by a piezoactuator 15 effects a decrease in volume of the ink chamber 16, as a result of which ink is expressed from the ink chamber opening through the opening 21 to the nozzle 31 and leaves the nozzle aperture 31 as a drop of ink. The ink flow direction is thereby deflected corresponding to the distance from the middle of the ink chamber opening 16 to the middle line of the intermediate plate 12. The deflection would be correspondingly shortened if the ink chambers 16 and 17 are formed in the intermediate plate 12.

Although modifications and changes may be suggested by those skilled in the art, it is the intention of the inventors to embody within the patent warranted hereon all changes and modifications as reasonably and properly come within the scope of their contribution to the art.

We claim as our invention:

1. An ink printer head comprising:

a plurality of individual edge shooter ink printer modules successively disposed in side-by-side contact and forming an assembly having a front face, each of said ink printer modules comprising a plurality of stacked module plates with some of said module plates on each module respectively containing a plurality of ink chambers and each ink chamber having an associated ink chamber opening disposed in said front face of said assembly so that said front face of said assembly has a number of said ink chamber openings, said assembly including a plurality of plate-shaped piezoelectric actuators, each ink chamber having one of said piezoelectric actuators adjacent thereto for ejecting ink from the ink chamber adjacent to the piezoelectric actuator through the associated ink chamber opening, each of said ink printer modules having a first column of said ink chamber openings and a second column of said ink chamber openings spaced from said first column of ink chamber openings, each of said ink chamber openings having a first dimension in a column direction extending along each of said columns;

an adapter plate disposed adjacent and in contact with said front face of said assembly and having a plurality of openings corresponding in number to said number of ink chamber openings in said front face of said assembly, said adapter plate having a front face;

a nozzle plate disposed adjacent and in contact with said front face of said adapter plate and having a plurality of nozzle apertures, said nozzle apertures being disposed in said nozzle plate in columns with one column allocated to each ink printer module, the nozzle apertures in respectively said columns being disposed equidistantly from each other in said column direction and said nozzle apertures being offset from column-to-column so that no nozzle aperture is aligned with another nozzle aperture in a direction orthogonal to said column direction, said apertures having a second dimension; and each opening in said adapter plate having a first region having said first dimension and a second region having said second dimension and said nozzle openings being disposed in said adapter plate with said first regions in registry with said ink chamber openings in said front face of said assembly and said second regions in registry with said nozzle apertures.

2. An ink printer head as claimed in claim 1 wherein each ink chamber opening is substantially rectangular in said front face of said assembly.

3. An ink printer head as claimed in claim 1 wherein each opening in said adapter plate is approximately semi-elliptical.

4. An ink printer head as claimed in claim 1 wherein each nozzle aperture in said nozzle plate is circular.

5. An ink printer head as claimed in claim 1 wherein each ink chamber opening has a rectangular shape in said front face of said assembly, each opening in said adapter plate is approximately semi-elliptical, and each nozzle aperture in said nozzle plate is circular.

6. An ink printer head as claimed in claim 1 wherein each of said ink printer modules comprises:

said adjacent module plates consisting of in sequence, a first cover plate, an intermediate plate with a first side adjacent and in contact with said first cover plate and a second, opposite side, a second cover plate adjacent and in contact with said second side of said intermediate plate, and a spacer plate adjacent and in contact with said second cover plate;

a first group of said ink chambers being disposed equidistantly beneath each other between said first cover plate and said first side of said intermediate plate and respectively having associated ink chamber openings forming said first column of ink chamber openings and a second group of said ink chambers being disposed equidistantly beneath one another between said second cover plate and said second, opposite side of said intermediate plate and respectively having associated nozzle openings forming said second column of nozzle openings, the ink chambers respectively comprising said first and second groups of said ink chambers being offset relative to each other in the column direction; and said plurality of plate-shaped piezoelectric actuators including a first group of said piezoelectric actuators carried on said first cover plate in registry with the ink chambers in said first group of ink chambers and a second group of said piezoelectric actuators carried on said second cover plate in registry with the ink chambers in said second group of ink chambers.

7. An ink printer head as claimed in claim 6 wherein the ink chambers comprising said first group of said ink chambers are disposed in said first cover plate and the ink chambers comprising said second plurality of ink chambers are disposed in said second cover plate.

8. An ink printer head as claimed in claim 6 wherein said ink chambers comprising said first group of said ink chambers are disposed in said first side of said intermediate plate and said ink chambers comprising said second group of said ink chambers are disposed in said second side of said intermediate plate.

9. An ink printer head as claimed in claim 6 wherein said spacer plate has a plurality of recesses in which said piezo-actuators are respectively disposed.

10. An ink printer head as claimed in claim 1 wherein said openings in said adapter plate are disposed in a plurality of pairs of columns, with each ink printer module being associated with one pair of said columns of openings in said adapter plate by virtue of the respective first regions of each opening in each pair of columns in said adapter plate being in registry with the nozzle openings in said first and second columns of one of said ink printer modules, and the respective second regions of the openings in each pair being meshed to align one below another and forming a column of said second regions in registry with one of said columns of nozzle apertures in said nozzle plate.

11. An ink printer head as claimed in claim 10 wherein each ink chamber opening is substantially rectangular in said front face of said assembly.

12. An ink printer head as claimed in claim 10 wherein each opening in said adapter plate is approximately semi-elliptical.

13. An ink printer head as claimed in claim 10 wherein each nozzle aperture in said nozzle plate is circular.

14. An ink printer head as claimed in claim 10 wherein each ink chamber opening has a rectangular shape in said front face of said assembly, each opening in said adapter plate is approximately semi-elliptical, and each nozzle aperture in said nozzle plate is circular.

* * * * *